United States Patent [19]

Lucking et al.

[11] Patent Number: 4,471,807

[45] Date of Patent: Sep. 18, 1984

[54] PRESS TAPS

[75] Inventors: Anthony J. Lucking, London; Kenneth R. Haines, Croydon, both of England

[73] Assignee: Waddington & Duval Limited, London, England

[21] Appl. No.: 362,072

[22] Filed: Mar. 26, 1982

[30] Foreign Application Priority Data

May 12, 1981 [GB] United Kingdom ..... 8114451

[51] Int. Cl.[3] ..... B67D 5/32; B65D 47/20

[52] U.S. Cl. ..... 137/614.19; 137/614.12; 137/614.18; 251/89; 251/342; 222/153; 222/506; 222/509; 222/545

[58] Field of Search ..... 222/153, 498, 510, 506, 222/509, 518, 545; 137/614.11, 614.12, 614.19, 614.18; 251/342, 89

[56] References Cited

U.S. PATENT DOCUMENTS

| | | | |
|---|---|---|---|
| 549,678 | 11/1895 | Miller | 251/342 |
| 2,574,534 | 11/1951 | Curto | 137/614.12 |
| 3,012,584 | 12/1961 | Perow et al. | 137/614.12 |
| 3,356,267 | 12/1967 | Scholle | 251/342 |
| 3,863,673 | 2/1975 | Sitton | 137/614.11 |
| 4,078,578 | 3/1978 | Buchholz | 137/614.11 |
| 4,351,455 | 9/1982 | Bond | 222/153 |

FOREIGN PATENT DOCUMENTS

| | | | |
|---|---|---|---|
| 959994 | 3/1957 | Fed. Rep. of Germany | 137/614.19 |

*Primary Examiner*—A. Michael Chambers

*Attorney, Agent, or Firm*—Wood, Herron & Evans

[57] ABSTRACT

A tap operated by a push button which acts to open a valve member which is biassed to the closed position, the valve member being for normal operation of the tap; also operated by the push button, but only on initial operation of the push button, is a plugging means which plugs the inlet of the tap and which after the initial operation remains out of the inlet. The arrangement ensures added protection against oxygen penetrating into a container fitted with the tap and is particularly useful for wine containers where the added protection ensures a longer shelf life. The use of a plugging means fitted tap avoids the necessity of special sealing equipment for the containers in the winery where containers are filled.

8 Claims, 6 Drawing Figures

10
16
8
2
7
6
1

30
36
53
22
28
27
26

PRESS TAPS

The present invention relates to taps of the kind used for containers, particularly containers which carry liquids such as table wine which deteriorate in storage due to the ingress of oxygen.

Known taps for such a use pierce diaphragms which are attached across the gland into which the tap fits. These diaphragms prevent the ingress of oxygen before initial use. Often it is convenient to fill the container through this gland but in this case problems have been found in the subsequent provision of the sealing diaphragm.

According to the present invention, there is provided a tap having a valve means for normal operation by a push button and an inlet plugging means between the inlet and valve means for initial operation by the push button.

The tap according to the invention has the advantage that prior to initial operation of the tap and during storage the plugging means provides added protection for the contents of the container to which the tap is fitted. Furthermore sealing of the container through a gland into which the tap if fitted may be achieved by insertion of the tap rather than by provision of a diaphragm. The once and for all action of the tap unsealing arrangement ensures better valve operation since all press effort on the push button in subsequent valve operation is directed to only valve operation.

Furthermore the invention ensure that the oxygen barrier is substantially improved without the requirement for any special equipment in the winery where the containers are filled for otherwise sealing the containers.

The plugging means may be axially movable at an angle preferably 90°, to the movement axis of the valve means or alternatively the valve means and plugging means may be movable in axially parallel or coaxial directions. In the former case the initial unplugging action is good and in the latter case the construction is very simple and economic to manufacture.

Figure 1:
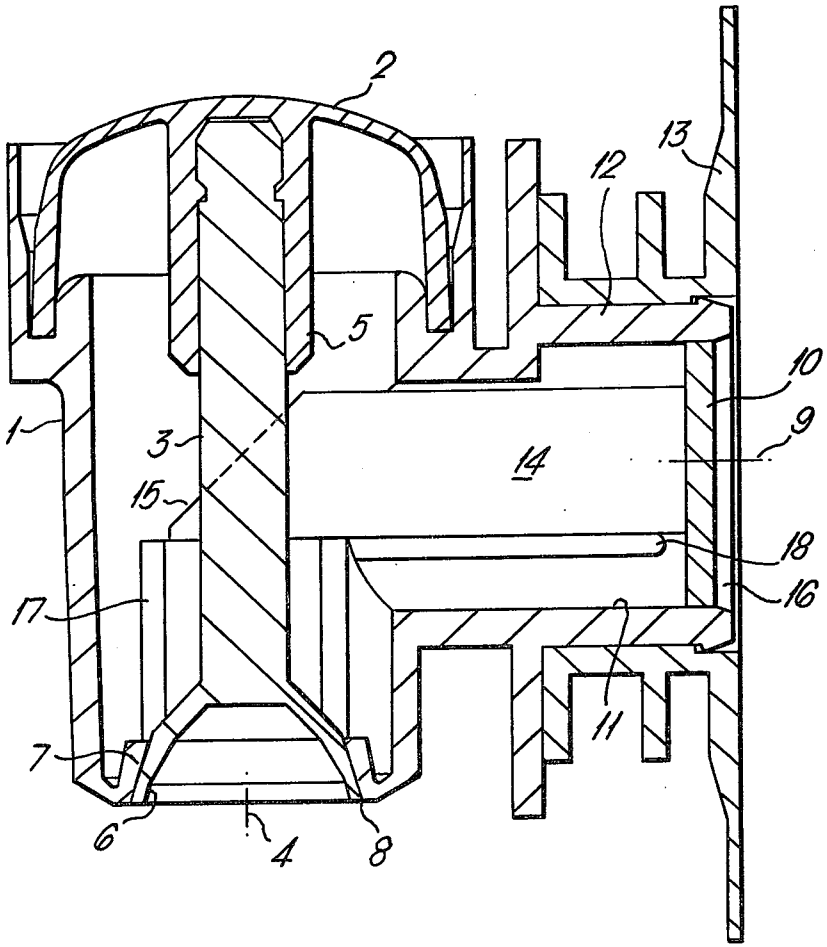
Figure 2:
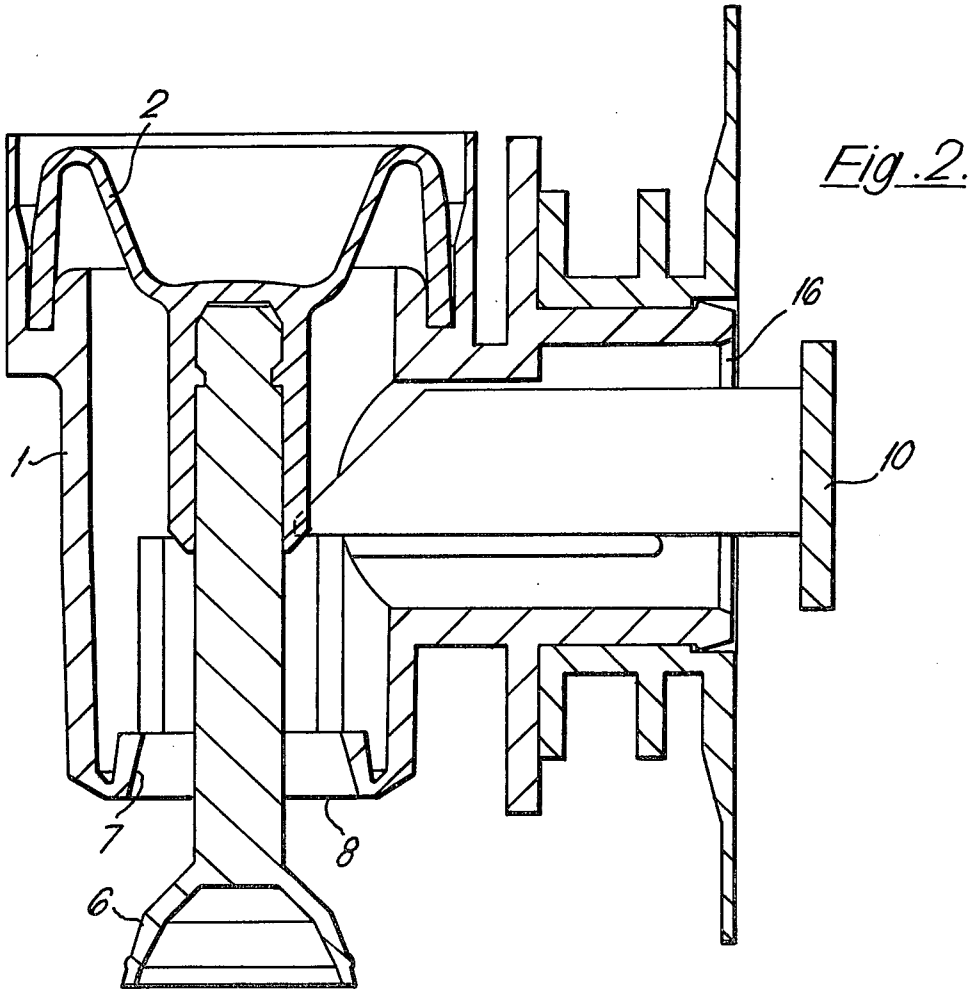
Figure 3:
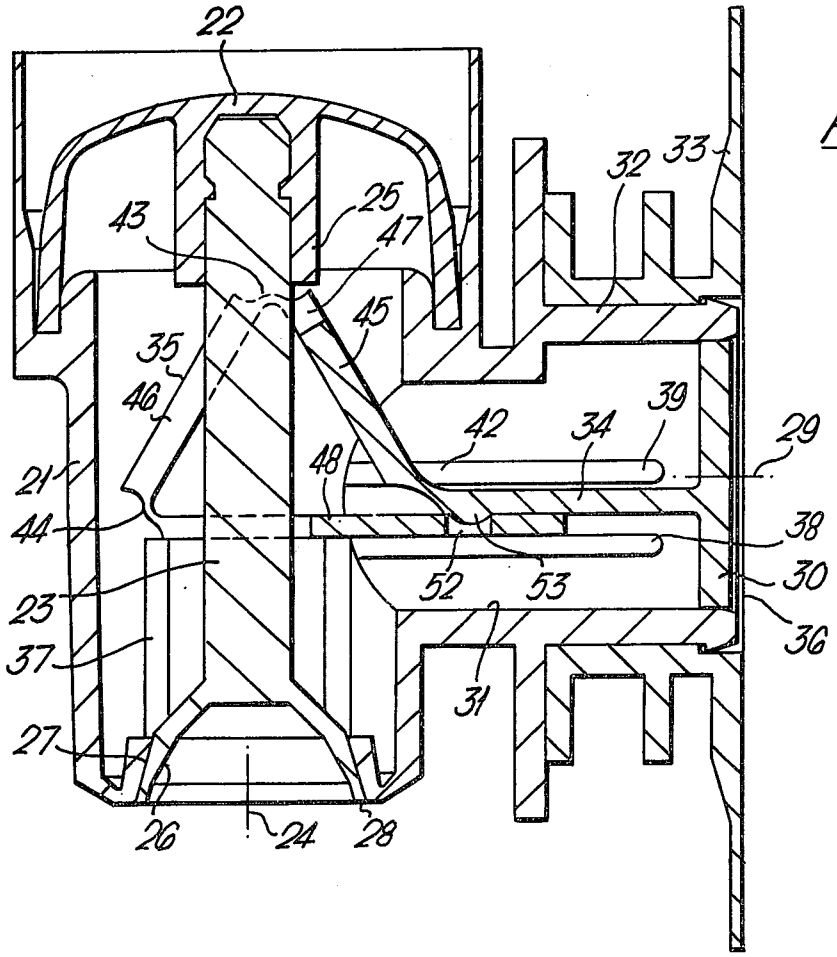
Figure 4:
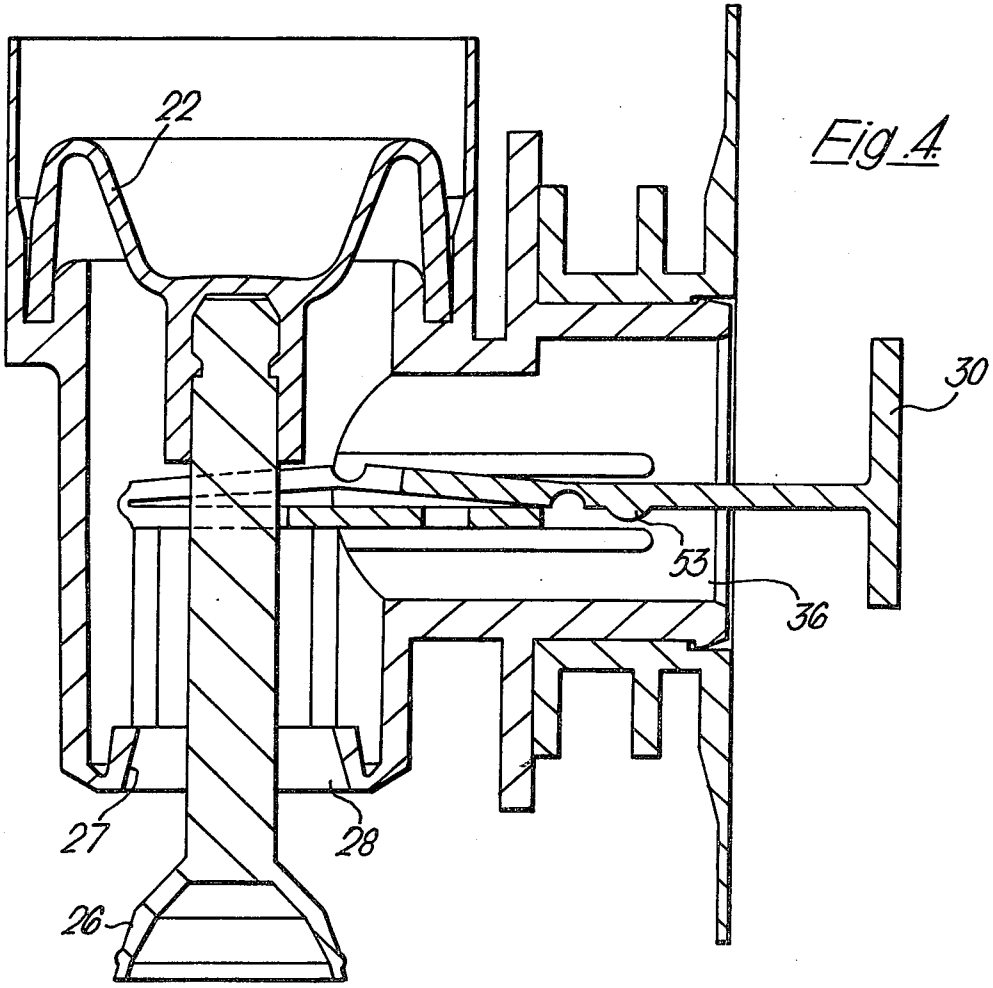
Figure 5:
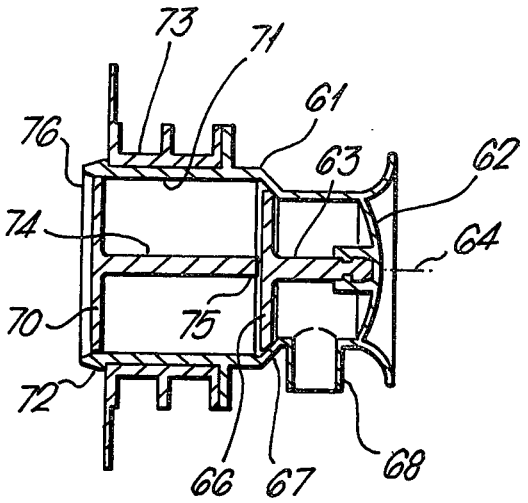
Figure 6:
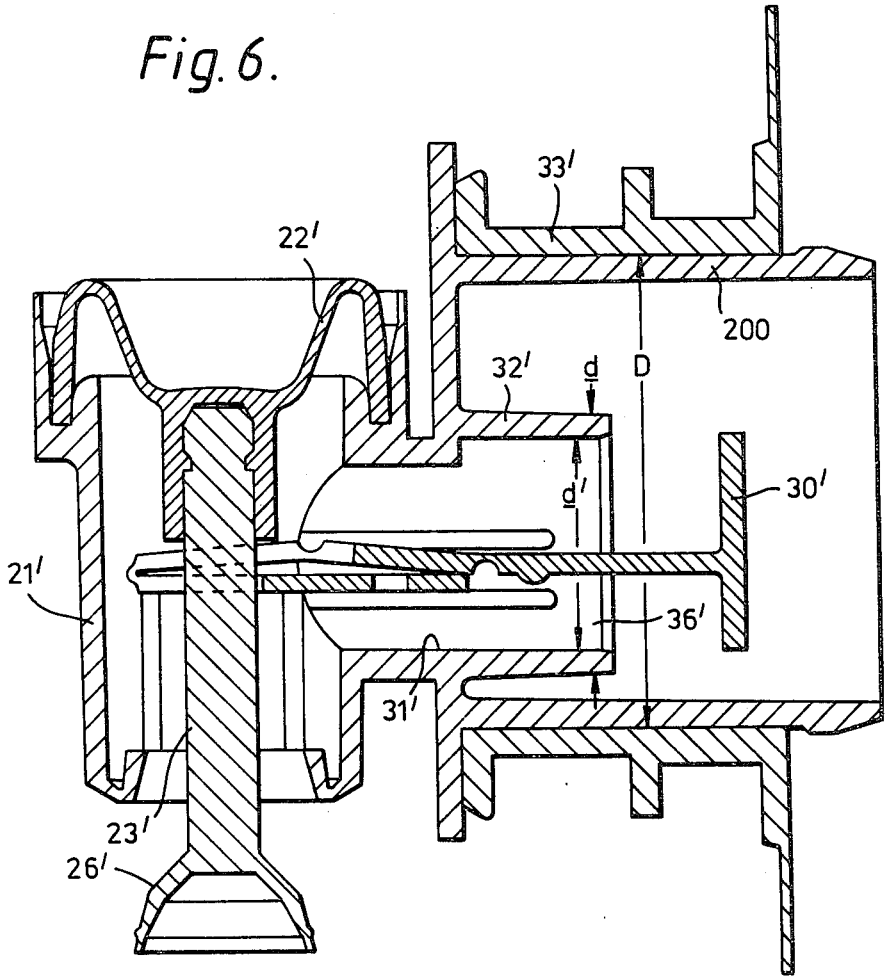

Embodiments of the invention will now be described by way of example with reference to the accompanying drawings in which:

FIG. 1 is a cross-section of a tap according to a first embodiment of the invention taken through the axes of the valve and plugging means, FIG. 2 is a cross-section of the tap of FIG. 1 in the open position, FIG. 3 is a cross-section of a tap according to a second embodiment of the invention taken through the axes of the valve and plugging means, FIG. 4 is a cross-section of the tap of FIG. 3 in the open position, FIG. 5 is a cross-section of a tap according to a third embodiment of the invention taken through a common axis of the valve and plugging means, and FIG. 6 is a cross-section of a further embodiment of the invention.

In the first embodiment the tap is formed with a valve body 1, a resilient press button 2 acting on a valve stem 3 movable in axis 4. The press button 2 has chamfered socket portion 5. The valve stem 3 has on its outer end a valve member 6 shown seated in FIG. 1 on conical seating 7. Valve member 6 seals the outlet 8 of the tap and is the valve member for controlling the normal or repetitive opening of the tap.

Axially movable in axis 9 at 90° to axis 4 is a plugging means or plug 10 which seals in the manner of a piston or plug on the inner cylindrical surface 11 of gland engaging portion 12 of body 1. The gland itself is shown at 13. The plug 10 has an operating stem 14 provided with an engagement surface 15 which is angled at 45° to the axes 4 and 9.

In operation the first time the tap is used the operator presses button 2, chamfered portion 5 then depresses and acts on surface 15 to press stem 14 and thus plug 10 outward so that tap inlet 16 is opened. Stem 14 is supported by thrust portion 17 and suitably by a rib or ribs 18. At the same time tap outlet 8 is opened and liquid is allowed to flow from the container (not shown) through the tap inlet past the stem 14 and out of the tap outlet. On release of the press button 2 the outlet is closed but the inlet remains open.

In the second embodiment the tap is formed with a valve body 21, a resilient press button 22 acting on a valve stem 23 movable in axis 24. The press button 22 has a socket portion 25. The valve stem 23 has on its outer end a valve member 26 shown seated in FIG. 3 on conical seating 27. Valve member 26 seals outlet 28 of the tap and is the valve member for controlling the normal or repetitive opening of the tap.

Axially movable in axis 29 at 90° to axis 24 is a plugging means or plug 30 which seals in the manner of a piston or plug on the inner cylindrical surface 31 of gland engaging portion 32 of body 21. The gland itself is shown at 33. The plug 30 has an operating stem or first plugging means portion 34 which has a triangular resilient actuating portion 35 which is formed by flat portions 45, 46 and 48. First portion 34 is hinged to the second portion 45 at 42; second portion 45 is hinged to third portion 46 and 43; and third portion 46 is hinged to fourth portion 48 at 44, the fourth portion abutting on thrust member 37. A slot 47 extends between and through portions 48, 46 and 45 so that the stem 23 passes through the triangular portion 35 to stabilise portion 35. Stem 34 slides between ribs 38 and 39. A recess or hole 52 is provided in fourth portion 48 into which engages a protrusion 53 provided on the stem or first portion 34.

In operation, the first time the tap according to the second embodiment is used, the operator presses button 22, socket portion 25 acts on triangular portion 35 to press stem 34 and thus plug 30 outward so that tap inlet 36 is opened. At the same time tap outlet 28 is opened and liquid is allowed to flow from the container (not shown) through the tap inlet, past the stem 34 and out of the tap outlet. On release of the press button 22, outlet is closed but the protrusion or peg 53 prevents the valve member 30 from re-entering and sealing the tap inlet 36.

In the third embodiment the tap is formed with a valve body 61, a resilient press button 62 acting on a valve stem 63 movable in axis 64. The valve stem 63 has on its outer end a valve member 66 shown seated in FIG. 5 on conical seating 67. Valve 66 seals the outlet 68 of the tap and is the valve means for sealing the normal or repetitive opening of the tap.

Coaxial with the valve stem 63 and movable in the common axis 64 is a plugging means or plug 70 which seals in the manner of a piston or plug on the inner cylindrical surface 71 of gland engaging portion 72 of body 61. The gland itself is shown at 73. Plug 70 has an operating stem 74 the inner end 75 of which engages with valve member 66.

In operation the first time the tap is used the operator presses button 62 so that stems 63 and 74 move towards the tap inlet 76 and the tap inlet 76 is opened. At the same time tap outlet 68 is opened and liquid is allowed to flow from the container (not shown) through the tap inlet past the stem 74 and out of the tap outlet. On release of the press button 62 the outlet is closed but the inelt normally remains open.

In all three embodiments the plug is suitably formed from polypropylene or from low or high density polyethylene which are suitable materials for preventing the ingress of oxygen into the container when in a storage condition. The tap body is suitably formed from polyethylene or of high density polyethylene.

A further advantage of the plug or piston type arrangement is that certain containers may be filled with a hot liquid at 80° to 90° C. which if allowed to contact the components of the valve means before cooling could affect these components to their detriment. Thus the plugging means act also as a protection for the valve means.

In FIG. 6 a further embodiment is shown in which a relatively large gland 3' of internal diameter D, of the order of 30 mm is provided with a tap 2' having an inlet body external diameter d of the order of 16 mm and an internal diameter d' of about 13 mm. The tap is mounted in a gland sleeve member 200 having of course the diameter D.

The purpose of this further embodiment is that some authorities hold that it is detrimental to wine to fill it into a container at a high velocity. At the same time, it is important to keep the inlet with diameter d' as small as possible to prevent oxygen ingress. By providing a large diameter D and a small diameter d' where D is about 30 mm and d' is about 13 mm the optimum characteristics are obtained.

Preferably D is in the range 20 to 40 mm, d' is in the range 10 to 16 mm and the ratio of d'/D is between ½ to 1.

Details and function of the plugging member and valve operation of the further embodiment are similar to the embodiment of FIG. 3 and will not be further described.

We claim:

1. A tap comprising a valve casing that includes a duct opening at one end at a fluid outlet and at the other end at a fluid inlet, a valve for normal open and close operation of said tap, said valve comprising a seat, and a valve member seating on said seat, said valve controlling fluid flow out said outlet during normal operation of said tap, a push button connected to said valve for manually opening said valve, said valve being normally biased closed until and unless said push button is pressed against said closure bias, a plug slidably mounted in said duct, said plug being movable from an initial plugging position interiorly of said duct where fluid flow through said tap is prevented to a normal operating position where fluid flow through said tap is permitted as controlled solely by said valve, and abutment means operably interconnected with said plug and with said push button, said valve member being movable along a motion axis oriented at an angle of about 90° to the motion axis of said plug, initial operation of said push button to open said tap causing said abutment means to move said plug from said initial plugging position to said normal operating position, said plug thereafter remaining in said normal operating position during subsequent operation of said push button so that said plug slides only on initial pressing of said push button against said normal valve bias and does not slide upon subsequent open and close operation of said valve by subsequent pressing of said push button.

2. A tap as set forth in claim 1, said valve comprising a valve stem fixed to said valve member, and said plug comprising a first portion operably connected to said plug, a second portion hinged at a first hinge to said first portion and extending toward said push button, a third portion hinged at a second hinge to said second portion, said third portion extending away from said push button, a fourth portion hinged at a third hinge to said third portion, said fourth portion extending towards said inlet and parallel to and lying against said first portion, a slot transverse to said second hinge and extending through said second, third and fourth portions, said valve stem extending through said slot to connect said push button and said valve member, and a guide provided interiorly of said casing to guide said first portion and, therefor, said plug toward said inlet on initial operation of said push button.

3. A tap as set forth in claim 2, said tap comprising a retainer partially carried by each of said first and fourth portions for holding said first and fourth portions in temporary engagement before initial operation of said push button, said retainer comprising a projection on one of said first and fourth portions and a projection receiving recess on the other of said fourth and first portions.

4. A tap as set forth in claim 2, said tap comprising a thrust member provided between said push button and said valve seat, said thrust member providing a surface against which a portion of said fourth portion is supported during initial operation of said push button.

5. A tap comprising a valve casing that includes a duct opening at one end at a fluid outlet and at the other end at a fluid inlet, a valve for normal open and close operation of said tap, said valve comprising a seat, a valve member seating on said seat, and a valve stem connected to said valve member, said valve being normally biased closed until and unless said push button is pressed against said closure bias, said valve controlling fluid flow out said fluid outlet during normal operation of said tap, a push button connected to said valve stem for manually opening said valve, an inlet plug slidably mounted in said duct, said plug being movable from an initial plugging position interiorly of said duct where fluid flow through said duct is prevented to a normal operating position outwardly of said duct where fluid flow through said duct can occur, and abutment means operably interconnected with said inlet plug and with said push button, initial operation of said push button to open said tap causing said abutment means to move said plug from said initial plugging position to said normal operating position, and said plug remaining in said normal operating position during subsequent operation of said push button, said abutment means comprising a first portion operably connected to said plug, a second portion hinged at a first hinge to said first portion and extending toward said push button, a third portion hinged at a second hinge to said second portion, said third portion extending away from said push button, a fourth portion hinged at a third hinge to said third portion, said fourth portion extending towards said inlet and parallel to and lying against said first portion, a slot transverse to said second hinge and extending through said second, third and fourth portions, said valve stem extending through said slot to connect said push button and said valve member, and a guide provided interiorly of said duct to guide said first portion and, therefor, said plug, toward said inlet on initial operation of said push button.

6. A tap as set forth in claim 5, said push button being operable to move said valve member along a first axis oriented at an angle of about 90° to the motion axis of said inlet plug.

7. A tap as set forth in claim 5, said tap comprising a retainer partially carried by each of said first and fourth portions for holding said first and fourth portions in temporary engagement before initial operation of said push button, said retainer comprising a projection on one of said first and fourth portions and a projection receiving recess on the other of said fourth and first portions.

8. A tap as set forth in claim 5, said tap comprising a thrust member provided between said push button and said valve seat, said thrust member providing a surface against which a portion of said fourth portion is supported during initial operation of said push button.

* * * * *

UNITED STATES PATENT AND TRADEMARK OFFICE

CERTIFICATE OF CORRECTION

PATENT NO. : 4,471,807

DATED : September 18, 1984

INVENTOR(S) : A.J. Lucking & K.R. Haines

It is certified that error appears in the above-identified patent and that said Letters Patent is hereby corrected as shown below:

Column 3, line 6
"inelt" should be -- inlet --

Column 3, line 23
"d" should be -- d --

Column 3
check last three paragraphs in spec. for all
"d" should be -- d --

Column 3, line 47
after "a seat" insert -- and --

Signed and Sealed this

Fourth Day of June 1985

[SEAL]

*Attest:*

DONALD J. QUIGG

*Attesting Officer*

*Acting Commissioner of Patents and Trademarks*